United States Patent [19]

Nutt et al.

[11] 3,983,481

[45] Sept. 28, 1976

[54] DIGITAL INTERVALOMETER

[75] Inventors: Ronald Nutt, Knoxville; Kelly Milam, Concord; Charles W. Williams, Powell, all of Tenn.

[73] Assignee: Ortec Incorporated, Oak Ridge, Tenn.

[22] Filed: Aug. 4, 1975

[21] Appl. No.: 601,907

[52] U.S. Cl. ..... 324/186; 324/78 D; 324/78 J

[51] Int. Cl.[2] ..... G04F 8/00

[58] Field of Search ..... 324/78 J, 78 D, 78 Q, 324/181, 186, 187, 188, 99 D

[56] References Cited

UNITED STATES PATENTS

| | | | |
|---|---|---|---|
| 3,675,127 | 7/1972 | McKiernan | 324/186 |
| 3,713,136 | 1/1973 | Nagy | 324/99 D |
| 3,728,626 | 4/1973 | Douglas | 324/99 D |
| 3,731,194 | 5/1973 | Favin | 324/186 |

*Primary Examiner*—Gerard R. Strecker
*Assistant Examiner*—Michael J. Tokar
*Attorney, Agent, or Firm*—Ralph L. Cadwallader; Leo M. Kelly

[57] ABSTRACT

In the digital intervalometer disclosed herein, a vernier measurement providing a resolution finer than one clock period is obtained by charging a single capacitor both during the interval between a start signal and a subsequent clock pulse and also during the interval between a clock pulse subsequent to a stop signal and a delayed stop signal. The analog voltage to which the capacitor is charged is converted to a digital value, which digital value is then combined with a clock count accumulated between the stop and start signals to provide a combined digital measurement having a resolution substantially finer than one clock period.

8 Claims, 6 Drawing Figures

CLOCK PULSES
START-GATE OUTPUT
START PULSE
STOP-GATE OUTPUT
STOP PULSE
DELAYED STOP PULSE
STOP-GATE BISTABLE
MAIN TIME INTERVAL
TIME EXPANDER OUTPUT
I
II
III
IV
V
VI

START
STOP
START GATING CIRCUIT
STOP GATING CIRCUIT
DELAY
DELAY
BISTABLE
BISTABLE
CURRENT SOURCE
CURRENT SOURCE
CURRENT SOURCE
CLOCK OSCILLATOR
ON
OFF
C1
13
15
17
19
21
23
25
27
29
30
31
33
37
39
41
42
43
46
47
I
II
III
IV
V
VI

VI
42
AND
I
OSCILLATOR
XII
43
FAST COMPARATOR
IV
56
FET AMPLIFIER
C1
XI
STORAGE CAPACITOR
DELAYED STOP
STOP-GATE INPUT
START INPUT
START-GATE INPUT
TD2
Δt2
TD1
Δt1
C1
STORAGE TIME
XI
FAST COMPARATOR
XII
STOP-GATE BISTABLE
IV
TIME-EXPANDER OUTPUT
VI 31
37
41
R1
R2
R3
R4
R5
R6
+V
Q2
R7
-V
Q1
Q4
R8
Q3
R9
Q6
Q5
R21
TD1
R22
TD2
R23
TD3
R11
R12
DELAYED START
START BISTABLE INPUT (33)
R13
R14
STOP BISTABLE INPUT (27)
DELAYED STOP
R15
R16
RESET

DIGITAL INTERVALOMETER

BACKGROUND OF THE INVENTION

This invention relates to a digital intervalometer and more particularly to apparatus operative to generate a digital vernier measurement providing a resolution substantially finer than one clock period.

Digital time interval measuring systems of various types are known in the art. Such systems typically count the number of cycles generated by a continuously operating oscillator during the interval between "start" and "stop" signals. The frequency of the oscillator is usually relatively high with respect to the expected interval duration, but there still exist certain errors and uncertainties correspondng to the timing of the start and stop with respect to the counting interval.

In applications where good time resolution is required, some method must be provided to account for the possible errors at the beginning and end of the counting interval. For illustration, it may be noted that, if the interval of time to be measured is not an exact multiple of the period of the oscillator, an error in exact measurement necessarily exists. This error can be reduced by increasing the oscillator frequency; but the extent to which this expedient may be used is, in turn, dependent upon the maximum speed at which available and economical counters and gating circuits can operate, and also upon the accuracy of the gating circuits used in the system. It will be apparent that the error may easily approach one complete cycle of the oscillator frequency. Therefore, when measuring time intervals in the range of microseconnds or smaller, there is a need for a device which will provide an accurate vernier measurement in digital form.

One system utilized in the prior art to measure the error-producing time periods, which may be referred to as vernier times, is to use separte time-to-amplitude converters to convert the start and stop vernier times to amplitudes and separate analog-to-digital converters to convert the amplitudes to digital values for combination with the clock count accumulated during the measured interval. Each time-to-amplitude converter is on from receipt of its corresponding start or stop pulse until a subsequent clock pulse. After conversion to digital values, the start value is added to the count of pulses during the interval and the stop value is subtracted from the sum. The use of separate time-to-amplitude converters and separate analog-to-digital converters contributes to the complexity of the system.

Among the several objects of the present invention may be noted the provision of a digital intervalometer of high accuracy; the provision of such a system which provides a vernier measurement giving a resolution substantially finer than one clock period; the provision of such a system which is highly reliable and is of relatively simple and inexpensive construction. Other objects and features will be in part apparent and in part pointed out hereinafter.

SUMMARY OF THE INVENTION

Briefly, apparatus according to the present invention is operative to provide a digital measurement of the interval occurring between externally applied start and stop signals and the apparatus employs a clock signal source providing a pulsatile clock signal having an accurately predetermined period. To provide a vernier measurement, a timing capacitor is charged at a predetermined rate from the occurrence of the start signal to a subsequent clock pulse and is also charged, at the same rate, from the occurrence of a clock pulse subsequent to the stop signal to a time following the stop signal by an interval related to an integer number of clock periods. A count is developed by counting clock periods between the clock pulse subsequent to the start signal and the clock pulse subsequent to the stop signal. Further means are provided for converting the analog voltage stored on the capacitor to a digital value and combining this digital value with the accumulated count to thereby provide a digital interval measurement having a resolution which is substantially finer than one clock period.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1B:
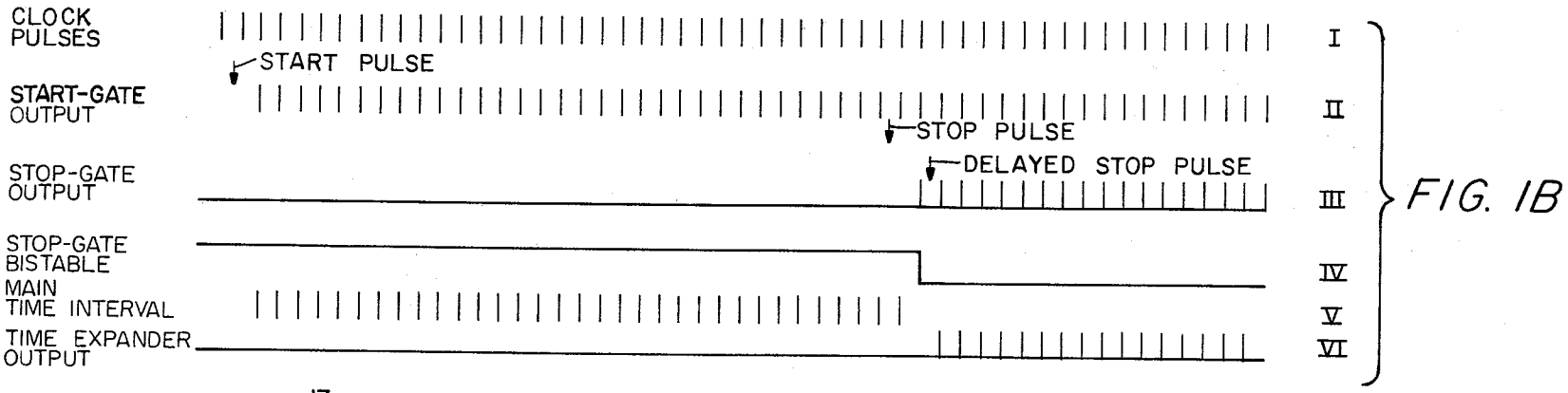
FIG. 1B represents various signals occurring within the circuit of FIG. 1A.
Figure 1A:
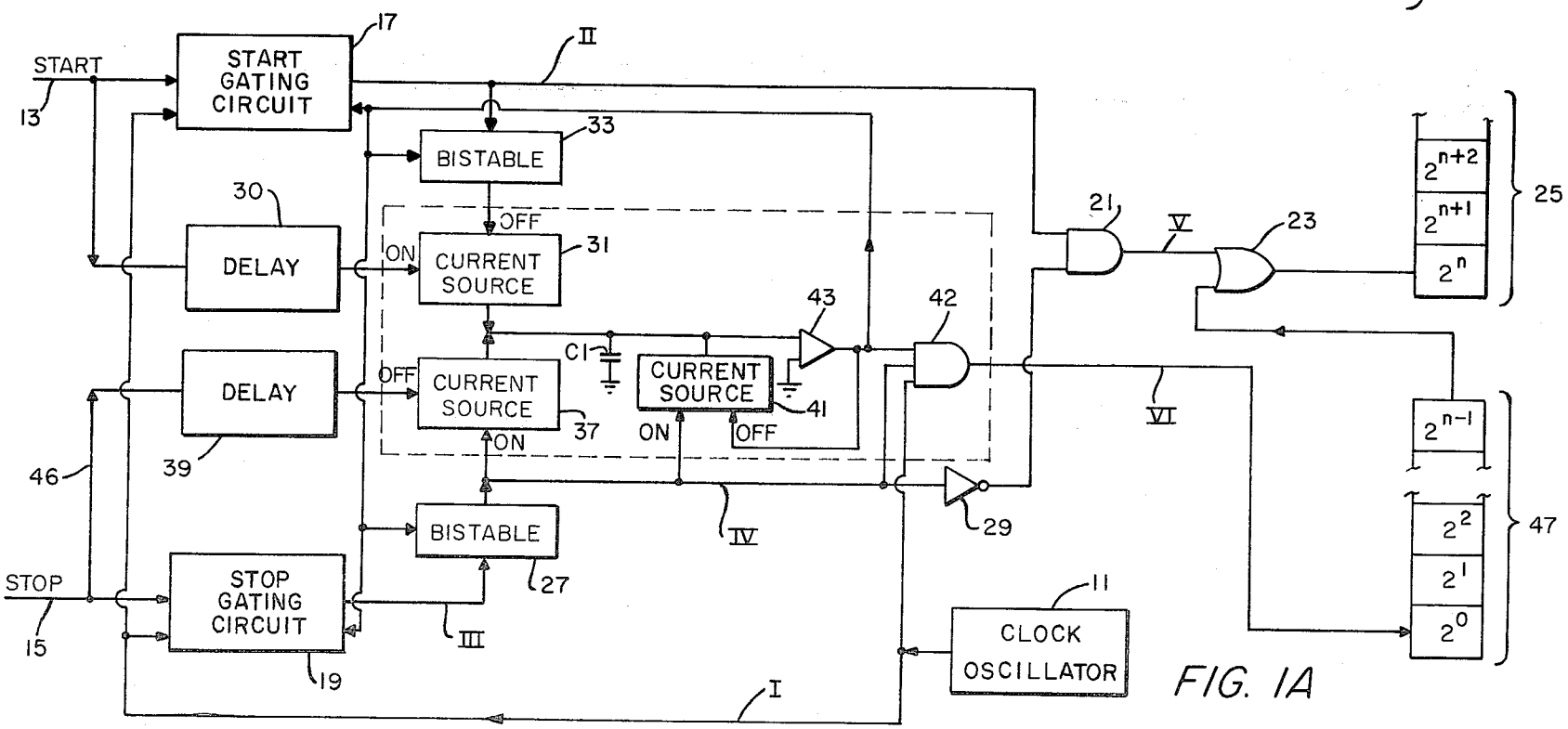
FIG. 1A is a schematic block diagram of a digital intervalometer in accordance with the present invention.

Referring now to FIG. 1A, the apparatus illustrated there is adapted to perform both a main time interval counting function and a vernier measurement providing a resolution finer than one clock period. The principal time base is a clock oscillator 11 providing a pulse clock signal having an accurately predetermined period. In generating a count corresponding generally to the main timing interval, the apparatus gates the clock signal both in response to a start signal, provided externally through a lead 13, and also in response to a stop signal, provided externally through a lead 15.

In order to avoid ambiguities which might be caused by the near coincidence of a start or stop signal with a clock pulse, the apparatus of FIG. 1A employs a pair of similar gating circuits 17 and 19, one responsive to the start signal and the other responsive to the stop signal, which are described in greater detail hereinafter. The clock signal is applied to both gating circuits. In general, it may at this point be noted that each of these circuits operates to pass the second clock pulse after the occurrence of the respective input signal and all subsequent clock pulses until the gating circuit is reset. The pulse train passed by start gating circuit 17 following application of a start signal is applied through an AND gate 21 and an OR gate 23, to a binary counter 25 comprising a series of binary counting registers or stages.

When the stop signal is applied, the second clock pulse following the stop signal, i.e. the first such pulse passed by the stop gating circuit, sets a bistable flip-flop 27. The output from the bistable flip-flop 27 is applied, through an inverter 29, as the other input to AND gate 21. As will be understood, this signal can operate to cut off or terminate a pulse train being transmitted to the counter 25. The count accumulated by the counter 25 is, in the following description, considered to be the main time interval.

Figures 3A, 3B:
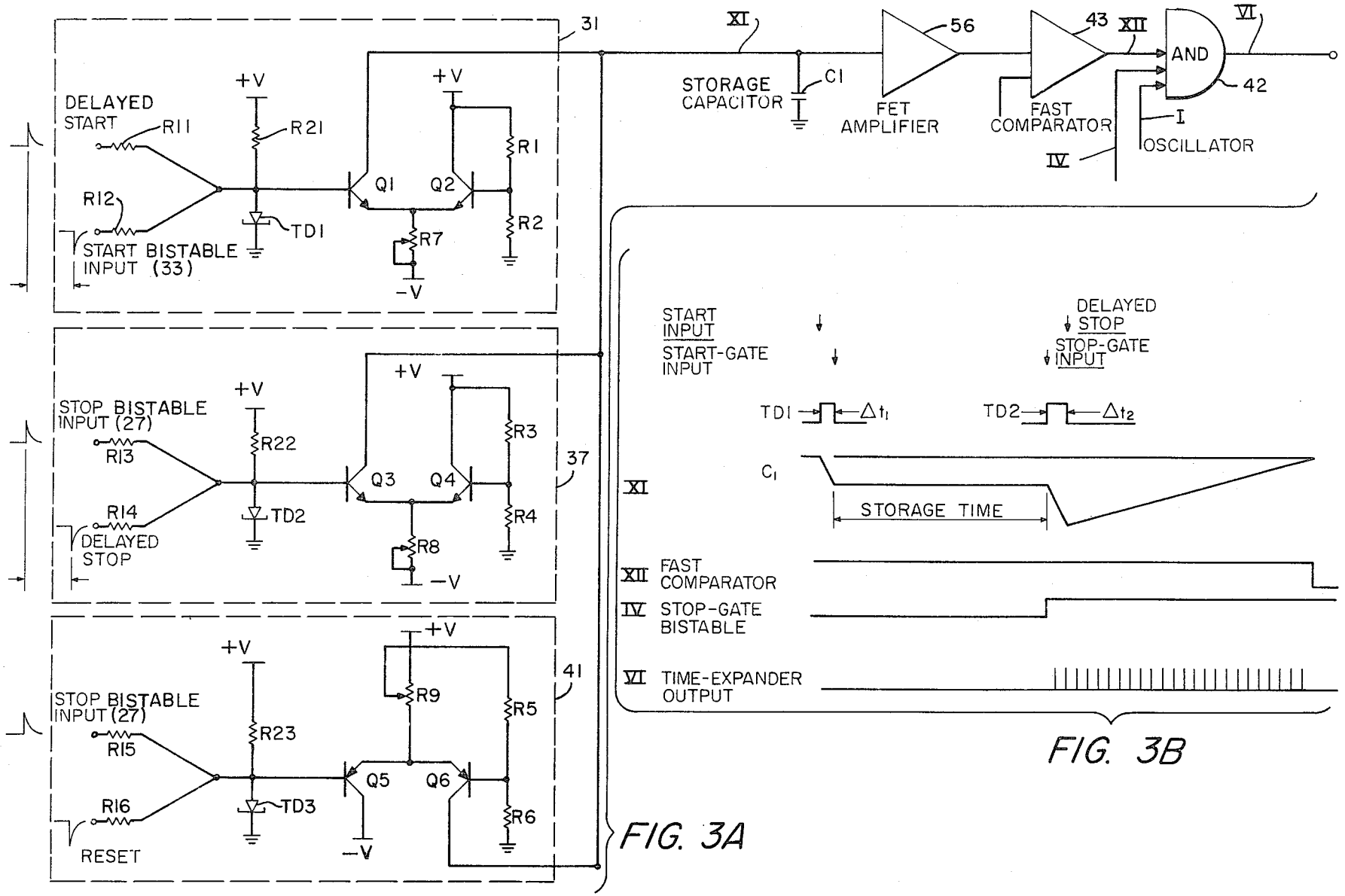
FIG. 3A is a schematic circuit diagram of so-called time expansion circuitry employed in the apparatus of FIG. 1A.
FIG. 3B represents various signals occurring within the circuitry of FIG. 3A.

As explained in greater detail hereinafter, vernier time measurement in accordance with the present invention is accomplished by charging a timing capacitor C1 over the intervals of interest. In addition to being applied to the start gating circuitry 17, the start signal is applied, through a delay circuit 30, to turn on a current source 31. Current source 31 is regulated so as to charge capacitor C1 at a preselected rate, i.e. so that the voltage on capacitor C1 changes linearly with respect to time. While, in the following description and in the claims, reference is made to charging and discharging and occasionally to positive and negative polarities, it should be understood that charging could be in either sense, i.e. either positive or negative, and that the claims should be understood to encompass the system operated in complementary polarity. In the particular embodiment illustrated, the charging referred to is in fact negative, as indicated in FIG. 3B.

The first clock pulse passed by the start gating circuitry 17, i.e. the second clock pulse following the application of a start signal, sets a bistable flip-flop 33 and the output signal from this flip-flop is applied to turn off the current source 31. The details of the charging circuitry are described in greater detail with reference to FIG. 3A discussed hereinafter but, at this point, it may be noted that the current source 31 operates to charge capacitor C1 during the interval between the application of the start signal and the second subsequent clock pulse as illustrated at XI in FIG. 3B.

A second current source 37 operates to charge capacitor C1 over the interval from the second clock pulse following the stop signal to a delay stop signal, i.e. a signal following the stop signal by an interval related to an integral number of clock periods. For this purpose, the current source 37 is turned on by the bistable flip-flop 27 and is turned off by a delay circuit 39, the delay being initiated by the stop signal. The current source 37 is regulated to provide the same predetermined charging rate as the current source 31. Since the charging is in the same sense or polarity during both intervals, the same current source could, under certain circumstances, be used to provide this capacitor charging over both intervals of interest, if suitable gating circuitry were provided.

As will be understood, the voltage to which the capacitor C1 is charged constitutes an analog value repesentative of the time over which the predetermined charging current was applied to the capacitor. In the practice of the present invention, this analog value is converted to a digital value which is then combined with the count accumulated in the binary counter 25 so as to obtain an interval measurement having a resolution finer than one clock period. While various analog-to-digital conversion techniques might be used, efficient use of the circuit elements already present in the system of the present embodiment is provided by converting the charge on capacitor C1 to a time interval by a linear discharge and counting clock pulse over the time required for the discharge. Capacitor C1 is discharged by means of a current source 41 which is turned on by the bistable flip-flop 27, i.e. responsive to a stop signal as described previously. The output signal from bistable flip-flop 27 is also applied as one input to an AND gate 42 which gates the clock pulses. The logic is such that, when the current source 41 is turned on, the gate 42 starts passing a train of pulses from the clock oscillator 11.

Current source 41 is regulated to provide a discharge current which is substantially smaller than and is preferably an integer fraction of the predetermined charging current applied by the sources 31 and 37. Thus, the discharge time will be relatively long with respect to the charge time so that an effective time expansion is performed. With this time expansion, the value of the voltage on capacitor C1 can be digitized using the same clock signal as was used for the main timing interval. Discharge of capacitor C1 back to ground potential is sensed by a comparator 43. The output signal generated by the comparator is applied as the third input to AND gate 42 and functions to terminate the pulse train passed by this gate.

As may be understood, the train of pulses passed by the gate 42 also represents a time interval but in this case each pulse represents an increment of time which is scaled down from the actual clock period by a factor corresponding to the ratio between the predetermined current provided by the sources 31 and 37 and the pedetermined current provided by the source 41. In the embodiment illustrated, this ratio is considered to be equal to $2^n$ power. This pulse train is applied to a binary counter 47 which is similar to the binary counter 25 and again comprises a series of counting register stages.

In accordance with the ratio of time expansion performed by the analog-to-digital converting circuitry, the binary counter 47 is assumed to have $n$ stages having binary weights corresponding to $2^0 - 2^{n-1}$. Any spill-over or carry generated in the last, i.e. most significant, stage in the counter 47 is applied as the second input to the OR gate 23 so that such carry signal will increment the first or least significant stage in the counter 25. Since the total time over which the first predetermined current value may be applied, i.e. from source 31 or source 37, is greater than one full clock period, this provision for a carry in the counting is necessary. The combined binary value stored in counters 25 and 47 represents a highly accurate measurement of the time interval between the start and stop signals, the portion of the values stored in the counter 47 representing in effect a vernier measurement accounting and allowing for offsets between the actual occurrences of the start and stop signals with respect to the phase of the free-running clock oscillator 11. While binary counters have been illustrated by way of example, it should be understood that decimal scalers might also be used.

With reference to FIG. 3A, the current sources 31, 37 and 41 each comprise a pair of matched transistors Q1 and Q2, Q3 and Q4, and Q5 and Q6 interconnected in a current switching configuration with a respective tunnel diode TD1, TD2, or TD3 controlling which transistor of the pair is conductive. One transistor in each pair is biased through a respective pair of resistors R1 and R2, R3 and R4, R5 and R6 while the emitters in each pair are connected together to an appropriate supply voltage through a respective adjustable resistance R7, R8, or R9 which permits the current value to be accurately adjusted.

The respective squarewave input signals which control each current source are differentiated, as by appropriate coupling capacitors (not shown), so as to develop appropriate switching transients and are applied to the respective tunnel diodes through isolation resistors R11–R16, the tunnel diodes TD1–TD3 being appropriately biased by resistances R21–R23.

As noted previously, the charging and discharging referred to are arbitrary in sense or polarity and in fact in this embodiment the charging by the current sources 33 and 37 is in a negative sense while the discharging is in a positive direction by the current source 41. Preferably, the voltage impressed on capacitor C1 is applied to comparator 43 through a buffer unity-gain amplifier 56 (not shown in FIG. 1A) so that leakage of charge from the storage capacitor is minimized.

The charging of capacitor C1 during the two vernier time measuring intervals and the discharging of the capacitor during the digitizing of this analog charge value is illustrated in FIG. 3B in relation to the various timing events described with greater particularity with reference to FIGS. 1A and 1B. As may be noted from the logic, the discharging current from 41 is, in fact, applied partially in overlapping relationship with the second charging interval but since the capacitor integrates and nets the total charge interval and since the timing occurs over the whole interval of discharging current, this overlap does not affect operation. It should be understood that separate non-overlapping discharge time might also be provided without varying from the intent of the present invention.

Figure 2A:
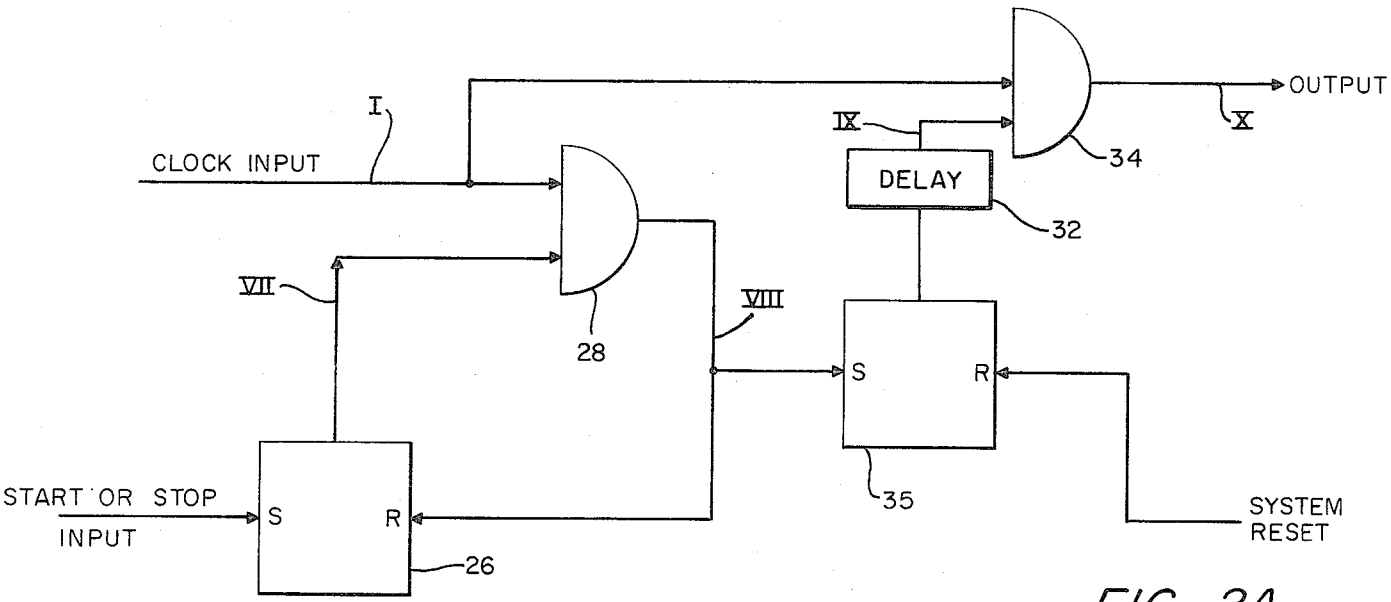
FIG. 2A is a schematic block diagram of gating circuitry employed in the apparatus of FIG. 1.
Figure 2B:
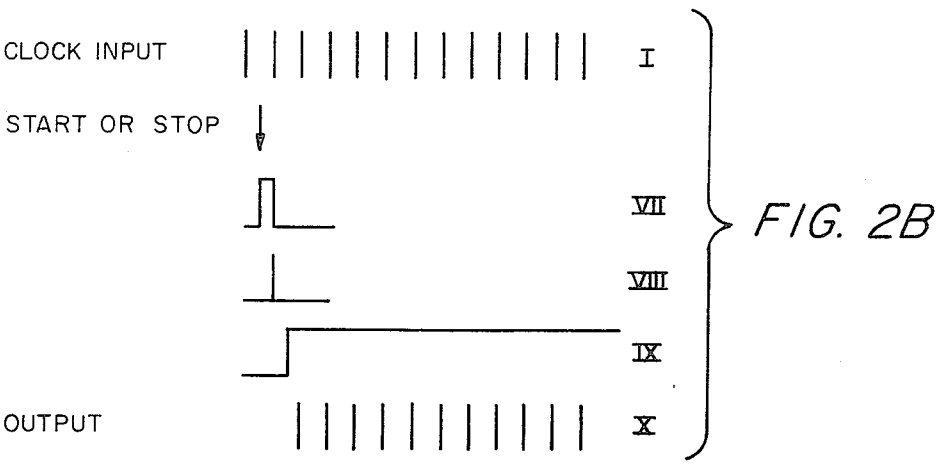
FIG. 2B represents various signals occurring within the circuit of FIG. 2A.

The gating circuit employed at 17 and 19 in FIG. 1A is illustrated in greater detail in FIG. 2. The start (or stop) signal is applied to set a bistable flip-flop 26 while the output of the flip-flop 26 is combined in an AND gate 28 with the clock signal, the output from the AND gate 28 being applied to the reset input of bistable flip-flop 26 and also the set input of a second bistable flip-flop 35. The output signal from flip-flop 35 is applied, through a delay circuit 32, to an AND gate 34 where it functions to gate the clock signal. A feature of this logic is that ambiguity is eliminated when the start signal is closely coincident with the oscillator pulse. In this case, the AND gate 28 either produces a pulse large enough to set the bistable flip-flop 35 or the first clock pulse is ignored and the second clock pulse is accepted. If the first clock pulse is accepted, the capacitor C1 (FIG. 1) will be charged for an interval corresponding to one clock period. If, however, the coincident pulse does not set flip-flop 35, the capacitor C1 will be charged for an interval corresponding to two clock periods but the main time interval will correspondingly be decreased by one pulse, since the AND gate 34 will be in effect closed during the coincident pulse.

Summarizing then, the sequential operation of this system is as follows. From the application of a start signal, after a suitable delay, the capacitor C1 is charged at a predetermined rate until the second clock pulse after the start signal. This increment of charge is in effect stored or held on the capacitor C1 during the main counting interval. The second and subsequent clock pulses following this start interval are counted in a binary counter 25. A stop signal causes the counting to be terminated with the second clock pulse following the application of the stop signal. The second clock pulse following the stop signal also initiates a second period of charging of the capacitor C1, this latter charging being terminated a predetermined time interval after the application of the stop signal. At this point, the voltage on the capacitor represents a vernier measurement of the offset of the start and stop signals with respect to the clock pulses. This voltage, an analog value, is digitized by discharging the capacitor C1 at a pedetermined rate which is substantially smaller and preferably an integer fraction of the rate at which the capacitor was charged, thus effecting a time expansion during which counting of the clock pulses is again performed until the capacitor is discharged back to its initial state. At this point, the second counting sequence is terminated. The counts accumulated are combined so as to provide a precision overall measurement of the time between the start and stop signals, the count accumulated during the expanded time interval being in effect a vernier measurement. In order to provide finite charging intervals of appropriate length under virtually all conditions of operation, the charging intervals are adjusted by means of the delay circuits 30 and 39. While the delay provided by the stop delay circuit 39 is described as being related to an integer number of clock cycles, it will be seen that it is actually the relative magnitudes of the delays provided by the circuits 30 and 39 which is significant. Thus, calibration of the apparatus may be effected by adjustment of either delay. As will also be understood by those skilled in the art, the vernier measurement, being digitized to values corresponding to times in the order of fractions of nanoseconds, will not be perfectly accurate in an absolute sense but will be accurate and useful in performing relative measurements. Absolute measurement is, in effect, prevented by delay introduced through the wiring and connecting circuitry, since even a few inches of conductor can introduce a delay measurable with the apparatus of the present invention.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. Apparatus for providing a digital measurement of the interval between start and stop signals, said apparatus comprising:

a clock signal source providing a pulsatile clock signal having an accurately predetermined period;

a timing capacitor;

means for charging said chapacitor, starting at a predetermined starting voltage, at a first predetermined rate from the occurrence of said start signal to a subsequent clock pulse and for charging said capacitor at said first predetermined rate from the occurrence of a clock pulse subsequent to said stop signal to a time following said stop signal by an interval corresponding to an integer number of clock periods;

means including a first series of counting register stages for counting clock periods between said clock pulse subsequent to said start signal and said clock pulse subsequent to said stop signal;

means operative after the second charging interval for discharging said capacitor at a second predetermined rate which is substantially less than said first rate and which is an integer fraction of said first rate; and means including a second series of counting register stages for counting clock periods during discharging of said capacitor back to said predetermined starting voltage, the two counting means being provided with means permitting carrys from the most significant stage of said second series of register stages to the least significant stage of said first series of register stages, whereby the count accumulated in the two counting means togethr represents the interval between said start and stop signals with a resolution substantially finer than one clock period.

2. Apparatus as set forth in claim 1 wherein said charging means and said discharging means are regulated current sources.

3. Apparatus as set forth in claim 2 wherein said charging means charges said capacitor in a negative sense and said discharging means charges said capacitor in a positive sense.

4. Apparatus as set forth in claim 2 wherein the ratio of said first rate to said second rate corresponds to the maximum count which can be accumulated in said first series of counting registers.

5. Apparatus as set forth in claim 2 including a comparator for detecting when said capacitor is discharged by said discharging means back to its initial voltage.

6. Apparatus as set forth in claim 2 wherein said first and second series of counting registers are binary scalers.

7. A digital time intervalometer wherein time measurements are made by counting the number of clock pulses occurring in a given time interval which is initiated by a START signal and terminated by a STOP signal comprising:

an oscillator having a period for generating a continuous series of clock pulses;

START gate means connected to receive the clock pulses and the START signal and arranged to produce an output of clock pulses starting with the second clock pulse occurring after receipt of the START signal;

STOP gate means connected to receive the clock pulses and the STOP signal and arranged to produce an output signal starting with the second clock pulse occurring after receipt of the STOP signal;

a storage capacitor;

first current source means connected to receive the START signal and the output clock pulses from the START gate means and to furnish first charging current to the storage capacitor and arranged to commence furnishing said first charging current upon receipt of the START signal and to cease furnishing said first charging current upon receipt of the first output clock pulse from the START gate;

delay means connected to receive the STOP signal and arranged to furnish a delayed output signal occurring exactly two oscillator periods after receipt of the STOP signal;

second current source means connected to receive the output signal from the STOP gate means and the delayed output signal of the delay means and to furnish second charging current to the storage capacitor and arranged to commence furnishing said second charging current upon receipt of the output signal from the STOP gate means and to cease furnishing said second charging current upon receipt of the delayed output signal of the delay means;

third means connected to receive the output signal from the STOP gate means and arranged upon receipt of said signal to enable the flow of discharge current from the storage capacitor;

comparator means connected to the storage capacitor and a zero voltage reference and arranged to produce a comparator output signal when the voltage on the main storage capacitor goes through zero;

first AND circuit means connected to receive the clock pulses, the output signal from the STOP gate means and the comparator output signal and arranged to produce an output train of clock pulses between the time of receipt of the output signal from the STOP gate and the time of receipt of the comparator output signal;

second AND circuit means connected to receive the output of clock pulses from the START gate means and the output signal of the STOP gate means and arranged to produce an output train of clock pulses between the time of receipt of the output clock pulses from the START gate and the time of receipt of the output signal of the STOP gate means; and binary scaler circuit means having n binary stages with the first stage connected to receive the output train of pulses from the first AND circuit means and with the *n*th stage connected to receive the output train of pulses from the second AND circuit means, the ratio of the sum of the first and second storage capacitor charging currents to the storage capacitor discharge current being adjusted to be equal to $2^n$, $2^n$ pulses in the output train of pulses from the first AND circuit means being equal to one pulse in the output train of pulses from the second AND circuit means.

8. The improved method of measuring a short time interval wherein time measurements are made by counting the number of clock pulses produced by an oscillator having a period and occurring in said interval which is initiated by a START signal and terminated by a STOP signal comprising:

charging a storage capacitor at a first current during the time between the START signal and the first clock pulse counted during said time interval;

producing a delayed STOP signal after an interval corresponding to an integer number of oscillator periods after the STOP signal, further charging the storage capacitor at said first current during the time between a clock pulse after STOP signal and the delayed STOP signal;

discharging the storage capacitor at a third current equal to $1/n$ times the first charging current, where $n$ is a whole number;

counting the number of clock pulses during the interval at the nth stage of an n stage binary scaler; and counting the number of clock pulses occurring during the time the third discharge current drops from its maximum value to zero and scaling down said clock pulses in the first $n-1$ stages of said binary scaler.

* * * * *